United States Patent [19]

Thompson et al.

[11] 4,325,550

[45] Apr. 20, 1982

[54] PUTTER WITH SHAFT AXIS FOCUSSED AT BLADE KEEL

[75] Inventors: Stanley C. Thompson, Playa del Rey; Glenn H. Schmidt, Glendale, both of Calif.

[73] Assignee: Stan Thompson Golf Club Company, Culver City, Calif.

[21] Appl. No.: 174,625

[22] Filed: Aug. 1, 1980

[51] Int. Cl.[3] ..... A63B 53/04

[52] U.S. Cl. ..... 273/80 C; 273/167 A; 273/167 G

[58] Field of Search ..... 273/77 R, 80 C, 81.3, 273/163 R, 164, 167–175

[56] References Cited

U.S. PATENT DOCUMENTS

| | | | |
|---|---|---|---|
| D. 255,477 | 6/1980 | Gida | 273/167 C X |
| 1,250,296 | 12/1917 | Fitzjohn | 273/167 G X |
| 2,842,369 | 7/1958 | East | 273/164 |
| 3,176,987 | 4/1965 | Johnston | 273/167 A X |
| 3,194,564 | 7/1965 | Swan | 273/80 C X |
| 3,319,962 | 5/1967 | Summers | 273/167 G X |
| 3,399,898 | 9/1968 | Burkland | 273/80 C X |
| 3,430,963 | 3/1969 | Wozniak et al. | 273/80 C X |
| 3,462,155 | 8/1969 | Pelz | 273/167 A X |
| 3,567,227 | 3/1971 | Panks | 273/80 C X |
| 3,625,517 | 12/1971 | Durnack | 273/167 A X |
| 3,625,518 | 12/1971 | Solheim | 273/167 A X |
| 3,841,639 | 10/1974 | Werner | 273/167 A X |
| 3,961,796 | 6/1976 | Thompson | 273/167 A |
| 4,008,896 | 2/1977 | Gordos | 273/171 X |
| 4,173,343 | 11/1979 | Richilano | 273/169 |

FOREIGN PATENT DOCUMENTS

| | | | |
|---|---|---|---|
| 16148 | of 1892 | United Kingdom | 273/167 G |
| 1308748 | 3/1973 | United Kingdom | 273/167 |

*Primary Examiner*—Richard J. Apley

*Attorney, Agent, or Firm*—William W. Haefliger

[57] ABSTRACT

A golf putter comprises (a) a generally horizontally and laterally elongated head having a ball striking front face, a heel and a toe, (b) the head having an integral and downwardly projecting keel at the underside thereof, the keel located intermediate the toe and heel and extending in a rearward direction relative to the front face, and (c) an elongated generally upright shaft having an axis, the shaft connected to said head, (d) the shaft axis directed to intersect the keel.

5 Claims, 7 Drawing Figures

PUTTER WITH SHAFT AXIS FOCUSSED AT BLADE KEEL

BACKGROUND OF THE INVENTION

This invention relates generally to golf putters, and more particularly concerns an improved putter characterized as overcoming problems of undesirable deflection upon inadvertent engagement with the green turf, during stroking of a golf ball.

Golf putters commonly have flat undersides, or gently curved undersurfaces. During stroking of a ball, if the player inadvertently lowers the putter slightly, the head may engage the turf at a location causing the head to rotate slightly about the shaft axis, which results in misdirecting the ball. These effects are subtle, and not easily overcome by player adjustment of his stroke.

SUMMARY OF THE INVENTION

It is a major object of the invention to provide an improved putter which overcomes the above problem in that even if the player inadvertently lowers his club during stroking of the ball, the construction is such that the head will not rotate in response to head engagement with the turf, and despite the orientation of the club shaft at different inclinations from vertical.

Basically, the putter comprises, in combination;

(a) a generally horizontally and laterally elongated head having a ball striking front face, a heel and a toe, (b) the head having an integral and downwardly projecting keel at the underside thereof, the keel located intermediate the toe and heel and extending in a rearward direction relative to the front face, and (c) an elongated generally upright shaft having an axis, the shaft connected to said head, (d) the shaft axis directed to intersect the keel.

As will appear, the keel typically has a lowermost portion which is locally downwardly convex and which is intersected by the shaft axis, that portion being located beneath the center of the front face; a vertical marker or indicia at that front face and passing through the center may be viewed by the golfer to indicate the face center and the keel therebelow; and the head rear face may have different configurations, as will appear.

These and other objects and advantages of the invention, as well as the details of an illustrative embodiment, will be more fully understood from the following description and drawings, in which:

DRAWING DESCRIPTION

DETAILED DESCRIPTION

Figure 1:
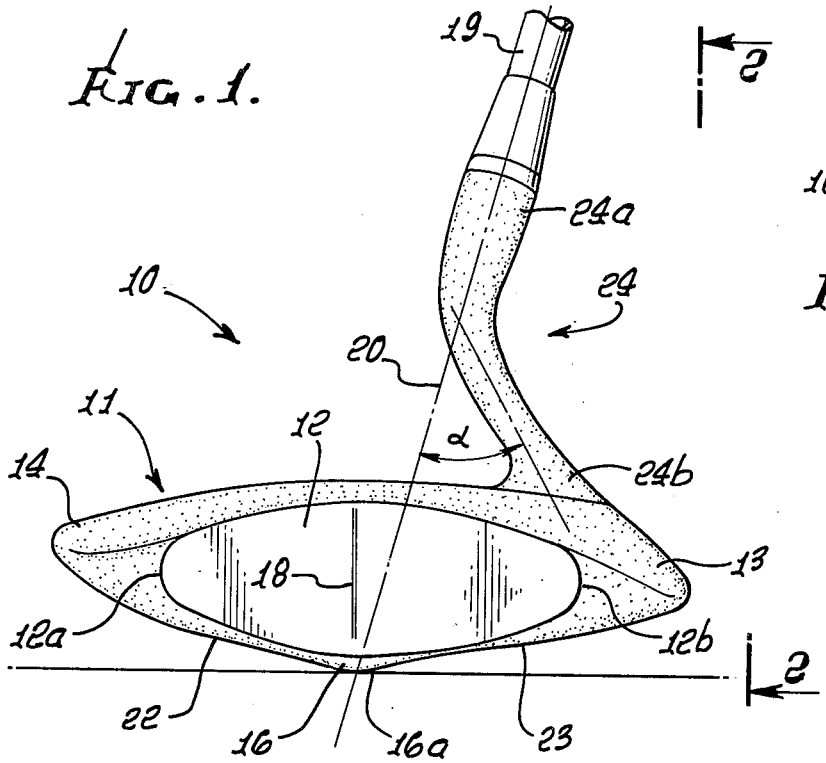
FIG. 1 is a front side elevation showing a putter head, hosel and shaft, incorporating the invention.
Figure 2:
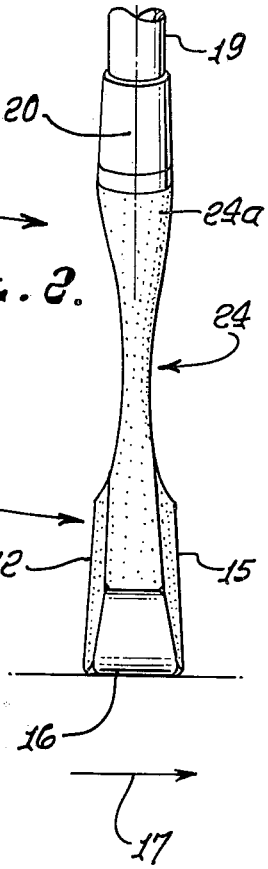
FIG. 2 is an end elevation on lines 2—2 of FIG. 1.

Referring first to FIGS. 1 and 2, the golf putter 10 includes a generally horizontally and laterally elongated head 11 having a ball striking front face 12, a heel 13, toe 14, and a rear face 15. The head has an integral and downwardly projecting keel 16 at its underside, the keel located intermediate the toe and heel and extends in a rearward direction (indicated by arrow 17 in FIG. 2). Note that the keel has a lowermost, downwardly convex portion **16*a*** which underlies the center of the front face.

That center may for example be indicated by a generally vertical indicia line or other mark 18. The slight offset from vertical of the plane of the front face (see FIG. 2) enables the golfer to view line 18, which he may orient vertically, or approximately vertically, to locate the heel as shown in FIG. 1. In that view, the remainder of the head 11 is then spaced above the level of keel lowermost portion **16*a***, so that only that portion is engageable with the putting green turf as the ball is stroked.

In accordance with an important aspect of the invention, the putter shaft 19 has a central axis 20 directed to intersect the keel. More specifically, the axis 20 is focused at lowermost convex portion **16*a* of the keel. As a result, the golfer's control of the shaft operates to control the location of the keel, which is normally the only portion of the head engageable with the turf. Since the keel is centered below the center of the face 12 which is aligned with the ball, the golfer has optimum control of his club; i.e. it will not be deflected (partially rotated about axis 20) by accidental engagement with the turf, since only the keel can engage the turf, and the keel is centered below the ball. This objective is assured or enhanced by initially aligning the head so that marker 18 is generally vertical, the head then being located as in FIG. 1, with head underside extents 22 and 23 clearly inclined upwardly and laterally away from the keel. Extents 22 and 23** are downwardly concave.

Note that flat front face 12 is generally elliptically elongated, laterally, with terminals **12*a* and 12*b* spaced from the head toe and heel. Also, hosel 24 has an upper portion 24*a* connected with the shaft and extending in the direction of axis 20, and a lower portion 24*b* connected to the head heel 13 and extending at a substantial angle $\alpha$ to axis 20** as well as spaced from that axis. Angle $\alpha$ is between 25° and 45°.

Referring to FIG. 2, rear face 15 is like front face 12 in that it extends in a plane slightly offset from vertical. Both the faces 12 and 13 taper upwardly, toward axis 20.

Figure 3:
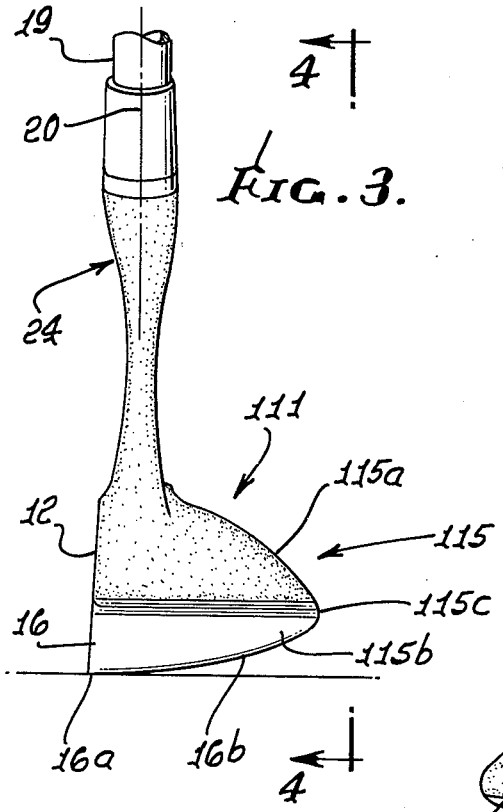
FIG. 3 is a view like FIG. 2, but showing a modified form of a putter.
Figure 4:
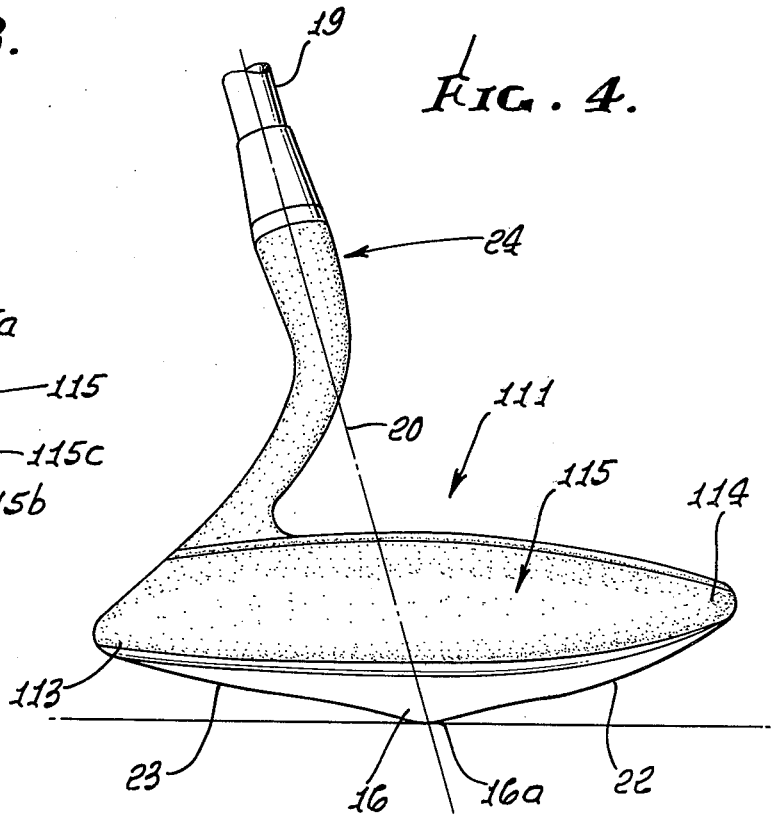
FIG. 4 is a rear side elevation taken on lines 4—4 of FIG. 3.

In each of the modifications shown in FIGS. 3–7, the front faces, and keels, and shaft axes have the same relationships as in FIGS. 1 and 2, and bear the same numbers. In FIGS. 3 and 4 the head 111 has a heel 113 and toe 114, and the rear side 115 of the head is rearwardly-tapered with upper and lower sides **115*a* and 115*b* converging toward rounded apex 115*c*. The keel 16 also tapers upwardly and rearwardly, at 16*b*. Accordingly, the putter head has greater mass than in FIGS. 1 and 2**.

Figure 5:
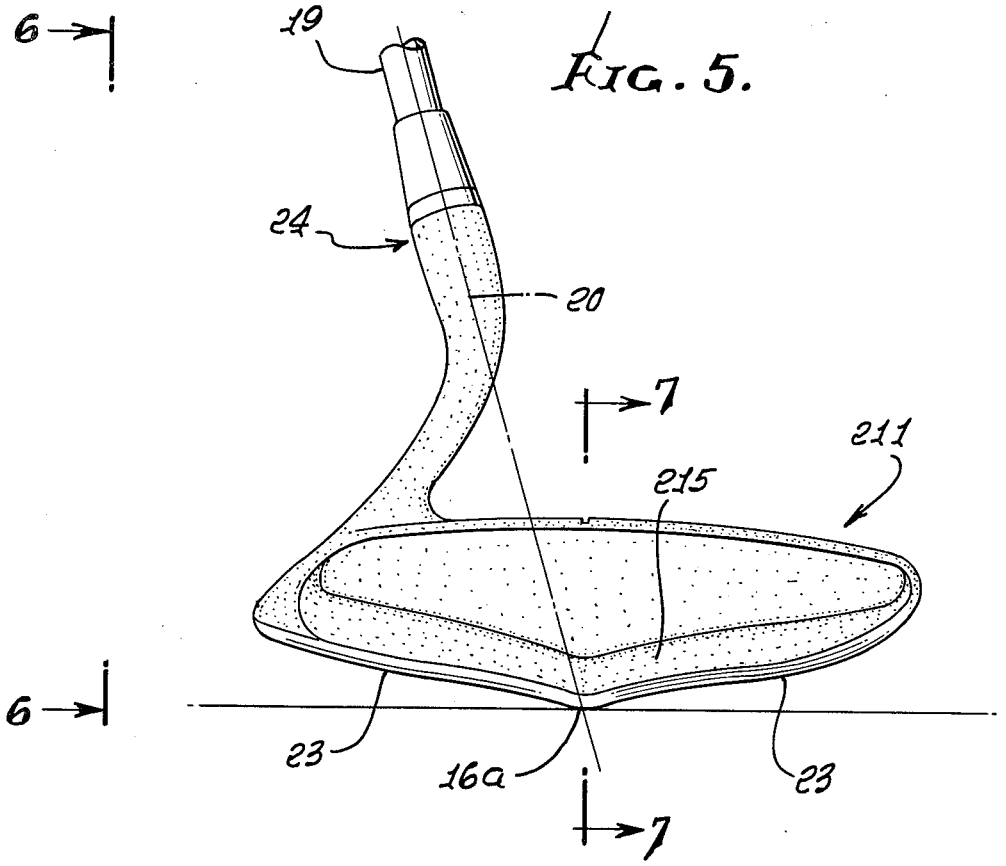
FIG. 5 is a view like FIG. 4 showing the rear side of yet another modified putter.
Figure 6:
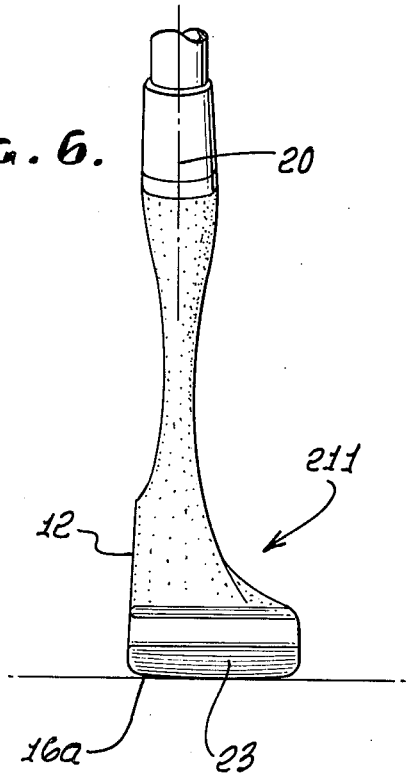
FIG. 6 is an end elevation on lines 6—6 of FIG. 5.
Figure 7:
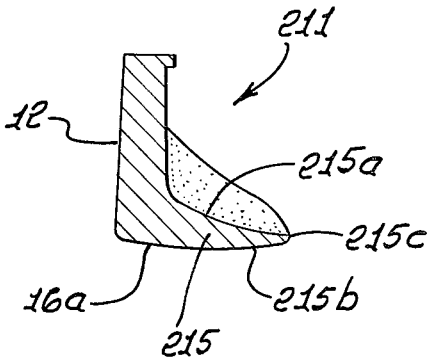
FIG. 7 is a section taken on lines 6—6 of FIG. 5.

In FIGS. 5–7, the head 211 has a heel 213 and toe 214. The rear side of the head has L-shaped configuration, with a lower, rearwardly projecting base 215. The latter has upper and lower sides **215*a* and 215*b* that taper rearwardly toward sharply rounded apex 215*c***.

We claim:

1. In a golf putter, the combination comprising (a) a generally horizontally and laterally elongated head having a ball striking front face, a heel and a toe, (b) the head having an integral and downwardly projecting keel at the underside thereof, the keel located intermediate the toe and heel and extending in a rearward direction relative to the front face, and (c) an elongated generally upright shaft having an axis, the shaft connected to said head, (d) the shaft axis directed to intersect the keel, (e) and a hosel interconnecting the shaft and head, the hosel having an upper portion extending in the direction of said axis, and a lower portion extending at a substantial angle to said axis and spaced therefrom to join the head near said heel, (f) said keel including a lowermost portion which is locally downwardly convex and located directly beneath the center of the front face, said front face being angled slightly upwardly and rearwardly relative to vertical when the keel lowermost portion is flatly engageable with the green turf, (g) said axis angled in relation to said head to pass in spaced relation to said face center and to intersect the lowermost extent of said keel, and the remainder of the head being located above the level of said keel lowermost portion, whereby the keel lowermost portion intersected by said axis is the only portion of the head engageable with the turf during stroking of a ball on a green, (h) the underside of the head being downwardly concave at opposite sides of the keel.

2. The combination of claim 1 wherein the putter head has a flat rear face which extends upwardly.

3. The combination of claim 1 wherein the putter has a rear side which tapers rearwardly.

4. The combination of claim 3 wherein the keel lowermost portion also tapers upwardly in a rearward direction.

5. The combination of claim 1 wherein the putter extends with L-shaped configuration, rearwardly.

* * * * *